US009393501B2

(12) United States Patent
Sze

(10) Patent No.: US 9,393,501 B2
(45) Date of Patent: Jul. 19, 2016

(54) POWER MODULE AND CONSTRUCTION TOY HAVING A POWER MODULE

(71) Applicant: Chau King Sze, Hong Kong (CN)

(72) Inventor: Chau King Sze, Hong Kong (CN)

( * ) Notice: Subject to any disclaimer, the term of this patent is extended or adjusted under 35 U.S.C. 154(b) by 99 days.

(21) Appl. No.: 14/161,035

(22) Filed: Jan. 22, 2014

(65) Prior Publication Data

US 2015/0202542 A1 Jul. 23, 2015

(51) Int. Cl.

| | |
|---|---|
| ***A63H 33/00*** | (2006.01) |
| ***A63H 33/04*** | (2006.01) |
| ***A63H 33/06*** | (2006.01) |
| ***A63H 33/10*** | (2006.01) |

(52) U.S. Cl.

CPC ..... *A63H 33/042* (2013.01); *A63H 33/062* (2013.01); *A63H 33/101* (2013.01)

(58) Field of Classification Search

CPC ..... F16F 1/04; F16F 1/041; A63G 11/04; G05D 16/0636; F03G 1/00; F03G 1/02; F03G 1/06; F03G 1/08; F03G 1/10; A63H 3/04; A63H 3/02; A63H 33/042; A63H 33/108; A63H 33/033; A63H 33/086

See application file for complete search history.

(56) References Cited

U.S. PATENT DOCUMENTS

| | | | | | |
|---|---|---|---|---|---|
| 1,187,659 | A * | 6/1916 | Savage | 446/356 |
| 2,035,308 | A * | 3/1936 | Ferber | 446/158 |
| 2,194,537 | A * | 3/1940 | Adams | 446/353 |
| 2,738,616 | A * | 3/1956 | Windle | 446/267 |
| 2,881,864 | A * | 4/1959 | Rubenstein | 185/37 |
| 3,030,783 | A * | 4/1962 | Schmidt | 464/57 |
| 3,367,063 | A * | 2/1968 | Bondesen et al. | 446/119 |
| 3,613,291 | A * | 10/1971 | Howe | 446/103 |
| 4,236,711 | A * | 12/1980 | Klingbeil | 472/72 |
| 4,494,417 | A * | 1/1985 | Larson et al. | 74/469 |
| 4,509,929 | A * | 4/1985 | Zawitz | 446/102 |
| 4,657,518 | A * | 4/1987 | Kelley et al. | 446/354 |
| 4,998,903 | A * | 3/1991 | Bolli et al. | 446/102 |
| 5,110,315 | A * | 5/1992 | Zawitz | 446/102 |
| 5,411,428 | A * | 5/1995 | Orii et al. | 446/90 |
| 5,413,519 | A * | 5/1995 | Simon | 446/487 |
| 5,628,667 | A * | 5/1997 | Levi | 446/278 |
| 5,738,558 | A * | 4/1998 | Zimmer et al. | 446/90 |
| 6,250,988 | B1 * | 6/2001 | Fleet | 446/486 |
| 6,585,553 | B1 * | 7/2003 | Fetridge et al. | 446/91 |
| 6,619,146 | B2 * | 9/2003 | Kerrebrock | 74/25 |
| 7,101,249 | B2 * | 9/2006 | Forti et al. | 446/247 |
| 7,537,506 | B2 * | 5/2009 | de la Torre | 446/353 |
| 2006/0014468 | A1 * | 1/2006 | Zawitz | A63H 33/00 446/166 |
| 2013/0183882 | A1 * | 7/2013 | Oschuetz et al. | 446/90 |
| 2014/0199912 | A1 * | 7/2014 | Fish | 446/383 |

* cited by examiner

*Primary Examiner* — Michael Dennis
*Assistant Examiner* — Urszula M Cegielnik
(74) *Attorney, Agent, or Firm* — Ware, Fressola, Maguire & Barber LLP

(57) ABSTRACT

A construction toy with a power module is disclosed. The construction toy has one power module and one or more slave members linked together to form a loop. The power module has a core assembly with a flexible rod which can be twisted to store potential energy from the kinetic energy when the rod is twisted. Upon releasing, the twisted rod in the core assembly unwinds itself to release the stored potential energy and causes the entire construction toy in motion. An anti-snap mechanism is incorporated to ensure the flexible rod does not snap in the event of over winding.

17 Claims, 6 Drawing Sheets

POWER MODULE AND CONSTRUCTION TOY HAVING A POWER MODULE

FIELD OF THE INVENTION

The present invention relates generally to a modular construction toy set and, in particular, to a construction toy having multiple elements, blocks or modules, which are chained to together to form a structural object.

BACKGROUND OF THE INVENTION

Modular construction toy sets have been around for years. Whether the construction modules are freely stacked or interlocked, these construction toy sets share one common trait; the finished structural object is stationary. With the present invention, the structure object can be set in motion.

SUMMARY OF THE INVENTION

The present invention provides a power module and a construction toy having such a power module. The construction toy has one power module and one or more slave members linked together to form a loop. The power module has a core assembly with a flexible rod which can be twisted to store potential energy from the kinetic energy when the rod is twisted. Upon releasing, the twisted rod in the core assembly unwinds itself to release the stored potential energy and causes the entire construction toy in motion.

Thus, the first aspect of the present invention is construction toy, comprising:

a power module; and a slave segment linked to the power module, wherein the power module comprises a core assembly operable at least in a first state and a second state, the core assembly configured to store kinetic energy as potential energy in the first state and to release the potential energy into kinetic energy in the second state. The slave segment may comprise a plurality of segment tubes rotatably coupled together to form a chain.

According to one embodiment of the present invention, the power module has a first module end and an opposing second module end, and the slave segment has a first segment end and an opposing second segment end, and wherein the first segment end of the slave segment is rotatably coupled to the second module end, and the second segment end of the slave segment is rotatably coupled to the first module end to form a loop.

According to one embodiment of the present invention, the core assembly comprises a flexible rod having a rod length, the flexible rod configured for twisting to store the potential energy.

According to one embodiment of the present invention, the core assembly further comprises a bushing, and the flexible rod is arranged to pass through the bushing, wherein the flexible rod comprises a first rod portion and a second rod portion with the bushing located between the first rod portion and the second portion.

According to one embodiment of the present invention, the power module further comprises a first tube for accommodating the first rod portion, and a second tube for accommodating the second rod portion, the first tube and the second tube arranged to rotatably engage with the bushing. The first tube has a first tube end arranged to engage with the bushing and a second tube end forming the first module end, and the second tube has a first tube end arranged to engage with the bushing and the second tube end forming the second module end.

According to the present invention, the flexible rod has a first rod end and an opposing second rod end, the first rod end located in the first rod portion, the second rod end located in the second rod portion, wherein the first rod end has a first restriction member and the second rod end has a second restriction member and wherein the first restriction member is arranged to engage with the first module end and the second restriction member is arranged to engage with the second module end, such that when the first tube is rotated relative to the second tube about a rotation direction, part of the flexible rod is caused to rotate along with the first tube, resulting in said twisting of the flexible rod to store the potential energy while the rod length is increased, and that when the rod length reaches a predetermined length, the first restriction member is arranged to disengage from the first module end.

According to one embodiment of the present invention, the first tube comprises two grooves formed therein near the second tube end, and the first restriction member comprises an anchor having two posts arranged to engage with the two grooves before the rod length reaches the predetermined length and to disengage from the two grooves when the rod length reaches the predetermined length, and wherein the first rod end has a pin inserted in the flexible rod, and the anchor also has a slot arranged to engage with the pin such that part of the flexible rod is caused to rotate along with the first tube when the anchor is engaged with the two grooves in the first tube.

According to one embodiment of the present invention, the core assembly further comprises a first compression spring surrounding the first rod portion between the bushing and the first restriction member for providing an urging force toward the first restriction member, and a second compression spring surrounding the second rod portion between the bushing and the second restriction member for providing an urging force toward the second restriction member.

According to one embodiment of the present invention, the first module end of the power module and the second segment end of the slave segment are coupled together with a snap stud, and the first segment end of the slave segment and the second module end of the power module segment are coupled together with another snap stud to form the loop.

The second aspect of the present invention is a power module for use in a construction toy, comprising:

a core assembly operable in a first state and a second state, the core assembly configured to store kinetic energy as potential energy in the first state and to release the potential energy into kinetic energy in the second state.

The core assembly comprises a flexible rod having a rod length, the flexible rod configured for twisting to store the potential energy.

According to one embodiment of the present invention, the power module further comprises: a bushing, the flexible rod arranged to pass through the bushing, wherein the flexible rod comprises a first rod portion and a second rod portion with the bushing located between the first rod portion and the second portion, a first tube for accommodating the first rod portion, and a second tube for accommodating the second rod portion, the first tube and the second tube arranged to rotatably engage with the bushing.

The power module has a first module end and second module end, and wherein the first tube has a first tube end arranged to engage with the bushing and a second tube end forming the first module end, and the second tube has a first tube end arranged to engage with the bushing and the second tube end forming the second module end.

The flexible rod has a first rod end and an opposing second rod end, the first rod end located in the first rod portion, the second rod end located in the second rod portion, wherein the first rod end has a first restriction member and the second rod end has a second restriction member, and wherein the first restriction member is arranged to engage with the first module end and the second restriction member is arranged to engage with the second module end, such that when the first tube is rotated relative to the second tube about a rotation direction, part of the flexible rod is caused to rotate along with the first tube, resulting in said twisting of the flexible rod while the rod length is increased, and that when the rod length reaches a predetermined length, the first restriction member is arranged to disengage from the first module end.

The first tube comprises two grooves formed therein near the second tube end, and the first restriction member comprises an anchor having two posts arranged to engage with the two grooves before the rod length reaches the predetermined length and to disengage from the two grooves when the rod length reaches the predetermined length, and wherein the first rod end has a pin inserted in the flexible rod, and the anchor also as a slot arranged to engage with the pin such that the flexible rod is caused to twist along with the first tube when the anchor is engaged with the two grooves in the first tube. The core assembly further comprises a first compression spring surrounding the first rod portion between the bushing and the first restriction member, and a second compression spring surrounding the second rod portion between the bushing and the second restriction member.

The third aspect of the present invention is a construction toy set, comprising:

a power module, and one or more slave segments tubes for forming a slave segment configured to couple to the power module to form a loop.

DETAILED DESCRIPTION OF THE INVENTION

Figure 1A:
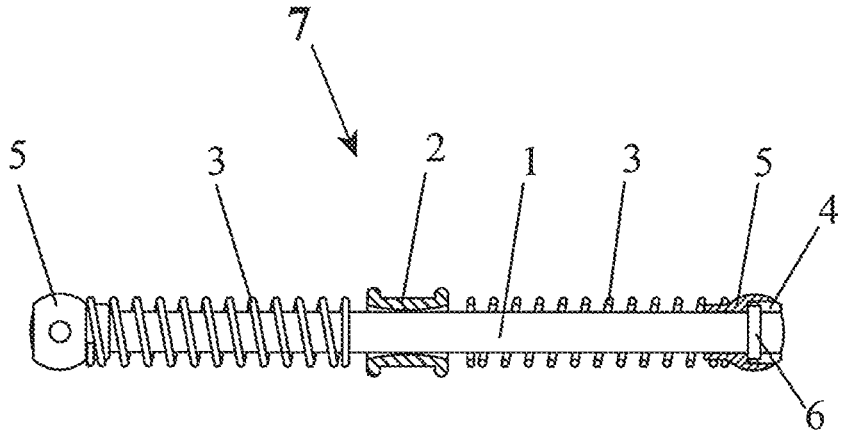
FIG. 1*a* and FIG. 1*b* show front view and side view of a flexible rod assembly, which can be used as the engine of a power module, for example.
Figure 1B:
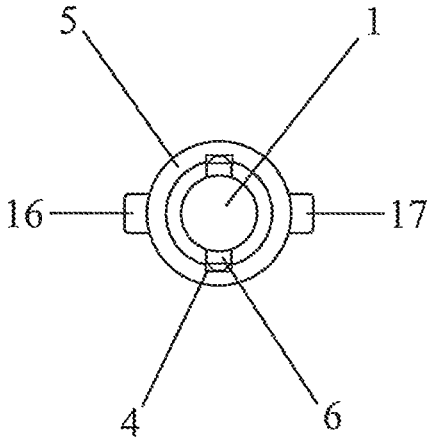

The present invention provides a modular construction toy including a rubber rod power module as the core member of the toy on which additional members are added. The rubber rod power module is described herein as a core assembly. FIG. 1*a* and FIG. 1*b* show the front view and the side view of a core assembly, and FIG. 2 shows an exploded view of the two-segment power module.

Figure 2:
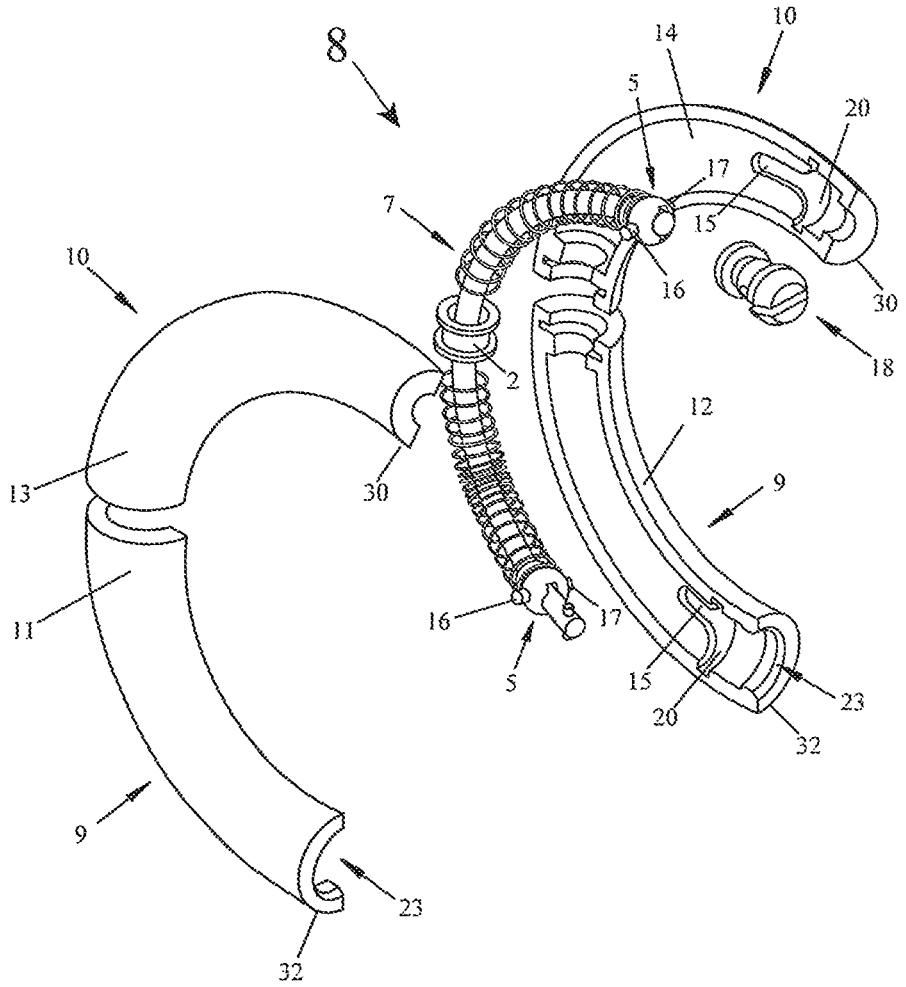
FIG. 2 shows an exploded view of the two-segment power module, according to one embodiment of the present invention.

FIGS. 1*a*, 1*b* and 2 illustrate a core assembly, which is configured as the engine of the power module for outputting radial force operative in accordance with embodiments of the present invention. As shown in FIG. 1*a*, the core assembly 7 has a flexible rod 1 of a certain length passing through a bushing 2, and two compression springs 3 located on each side of the bushing 2. One part of the flexible rod 1 is referred to as a first rod portion and another part of the flexible rod 1 is referred to as a second rod portion with the bushing 2 located between the first and second rod portions. Both ends of the flexible rod are affixed to a restriction member such as an anchor 5. In one embodiment of the present invention, each of the anchors 5 is affixed to the flexible rod 1 by means of pin 6 which is inserted through the body of the flexible rod 1 and seated in a slot 4 formed on anchor 5, as shown in FIG. 1*b*. Each of the anchors 5 has two substantially opposite posts 16 and 17. In one embodiment of the present invention, the flexible rod 1 is a solid core rod made of a flexible material, such as rubber, thermoplastic rubber (TPR) or silicone. In one embodiment of the present invention, the bushing 2 is made of acetal or nylon, for example. In one embodiment of the present invention, the anchors 5 are ball-shape anchors and the pin is made of steel or other metals, for example.

Referring to FIG. 2, the core assembly 7 is installed inside two torus segments or tubes 9, 10 on opposite sides of the bushing 2 to form a power module 8. The torus segments 9, 10 are arranged to accommodate the first and second rod portions. In one embodiment of the present invention, torus segment 9, 10 are each made of two half shells 11, 12, 13 and 14, for example. In one embodiment of the present invention, each of the half shells 11, 12, 13, 14 has a groove 15 dimensioned to engage with one of posts 16, 17 on anchor 5, so that anchor 5 is properly seated and anchored. The anchor can be a ball-shape anchor as shown. As shown in FIG. 2, each of the half shells 11, 12, 13, 14 has a first end adjacent to the bushing 2 and an open second end. The open ends of the half shells 13, 14 form a first module end 30 of the power module 8 and the open ends of the half shells 11, 12 form a second module end 32 of the power module 8. A groove 15 is formed inside each of the half shells 13, 14 near the first module end 30 and inside each of the half shells 11, 12 near the second module end 32. A circular groove 20 is formed inside the torus segment 10 near the first module end 32, communicating with the grooves 15 in the half shells 13, 14. Another circular groove 20 is formed inside the torus segment 9 near the second module end 30, communicating with the grooves 15 in the half shells 11, 12.

A freely rotatable snap stud 18 is positioned at open end of torus segment 10, while a circular receptacle 23 is formed on the open end of the torus segment 9.

Figure 3A:
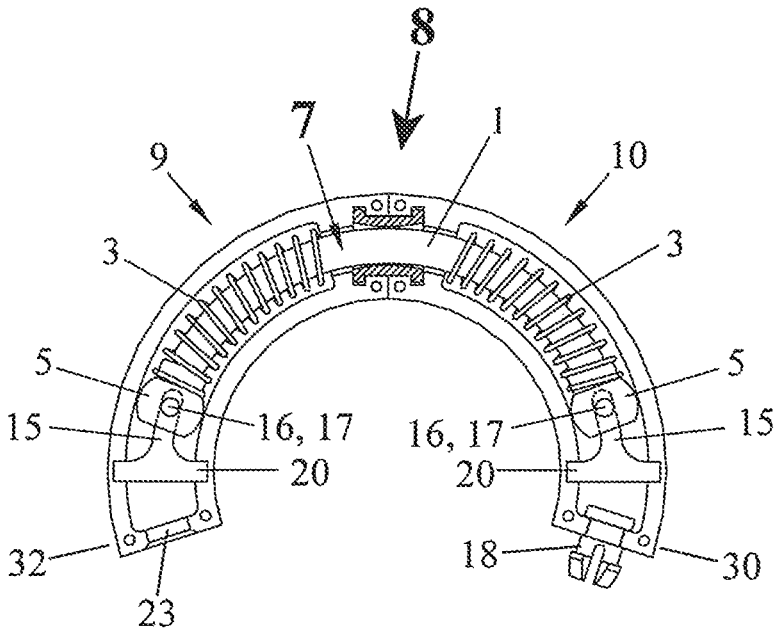
FIG. 3*a* and FIG. 3*b* illustrate an anti-snap mechanism operative in respect to different positions of the anchors during winding of the power module.
Figure 3B:
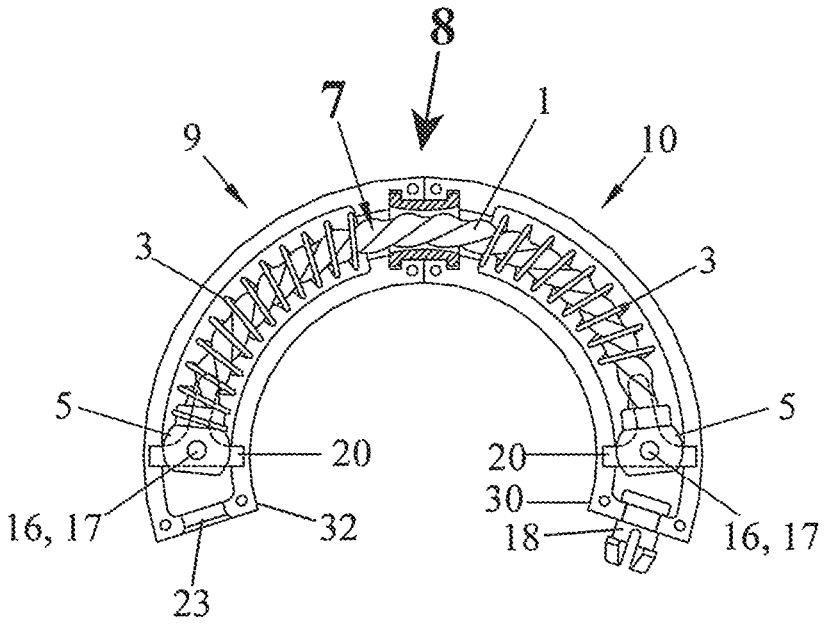

Referring now to FIGS. 3*a* and 3*b* which show how the core assembly 7 behaves when flexible rod 1 is at a relax state and at a fully wound state. When the flexible rod 1 in the power module 8 is not wound as shown in FIG. 3*a*, the anchor 5 inside in torus segments 9, 10 are seated at an upper position of the groove 15. The anchor 5 inside the torus segment 9 is engaged with the torus segment 9 and the anchor 5 inside the torus segment 10 is engaged with the torus segment 10. As such, when the torus segment 10 is rotated relative to the torus segment 9, for example, at least part of the flexible rod 1 is rotated along with the toms segment 10 and the flexible rod 1 becomes twisted. Every winding of the power module results in a small increment of the rod length of flexible rod 1. As the flexible rod 1 elongates, the compression springs 3 help push the anchors 5 further out toward the module ends 30, 32. Continuous winding of the power module 8 causes the further increase in the rod length of the flexible rod 1. Under the urging force of the compression springs 3, each of the anchors 5 transverses along the grooves 15 until the posts 16, 17 are pushed into the circular grooves 20, as shown in FIG. 3*b*. As such, the anchors 5 are no longer anchored in or engaged with the torus segments 9, 10. Such measure prevents flexible rod 1 from snapping caused by over winding. For visual clarity, last few turns of compression spring 3 in torus segment 10 are not shown.

Figure 4B:
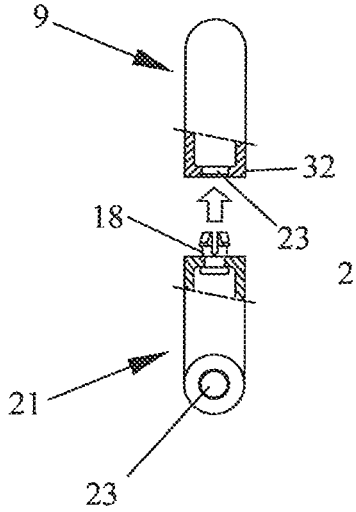
FIGS. 4*a*-4*c* show how various segments of the construction toy are linked, according to one embodiment of the present invention.
Figure 4A:
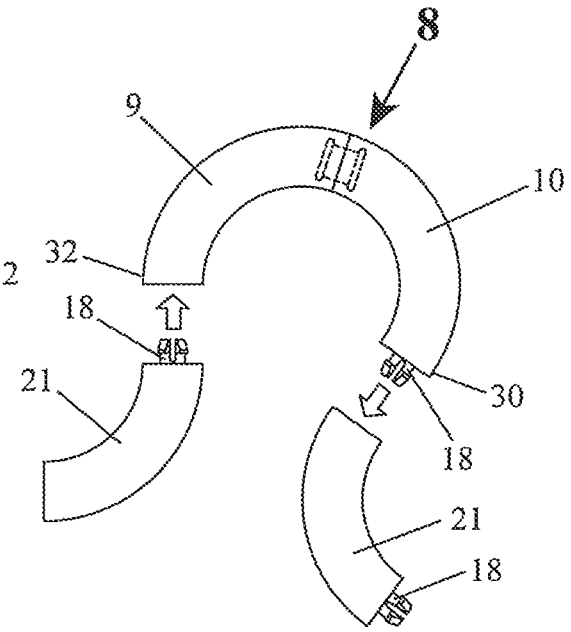
Figure 4C:
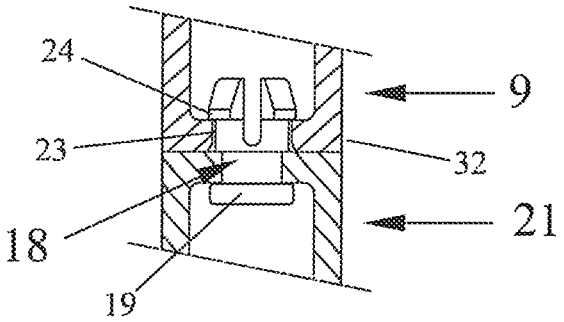

The power module 8, according to the present invention, can be linked with one or more slave members 21 to form a construction toy 100. Referring now to FIGS. 4*a* and 4*b*, which illustrate how the slave members 21 are chained or linked to power module 8. FIG. 4*a* shows two slave members 21 to be linked to the power module 8. FIG. 4*b* shows the snap stud 18 on one slave member 21 is snapped into the receptacle 23 on the torus segment 9 near the module end 32 of the power module 8. Likewise, the snap stud 18 on the module end 30 of the power module 8 is snapped into another slave member 21. As such, one slave member 21 is rotatably linked to torus segment 9 of power module 8 while the other slave member 21 accepts the snap stud 18 on torus segment 10 of power module 8. The slave members 21 as shown in FIG. 4*a* can be the first slave member and last slave member in a chain of slave members that forms a loop with a power module 8 (see FIG. 4*d*). The end of the slave member 21 that is linked to the module end and the end of the slave member 21 that is linked to the module end 30 are the first segment end and the second segment end of the chain of the slave members. FIG. 4*c* shows a slightly enlarged portion of the torus segment 9 and the slave member 21 after the snap stud 18 has been snapped into the second module end 32. As shown in FIG. 4*c*, the snap stud 18 has a flange 19 located inside an end of the slave member 21, and an interlock member 24 located inside the second module end 32. The flange 19 of the snap stud 18 is used to retain the position in the connection yet it allows the snap stud to rotate relative to the slave member 21.

Figure 4D:
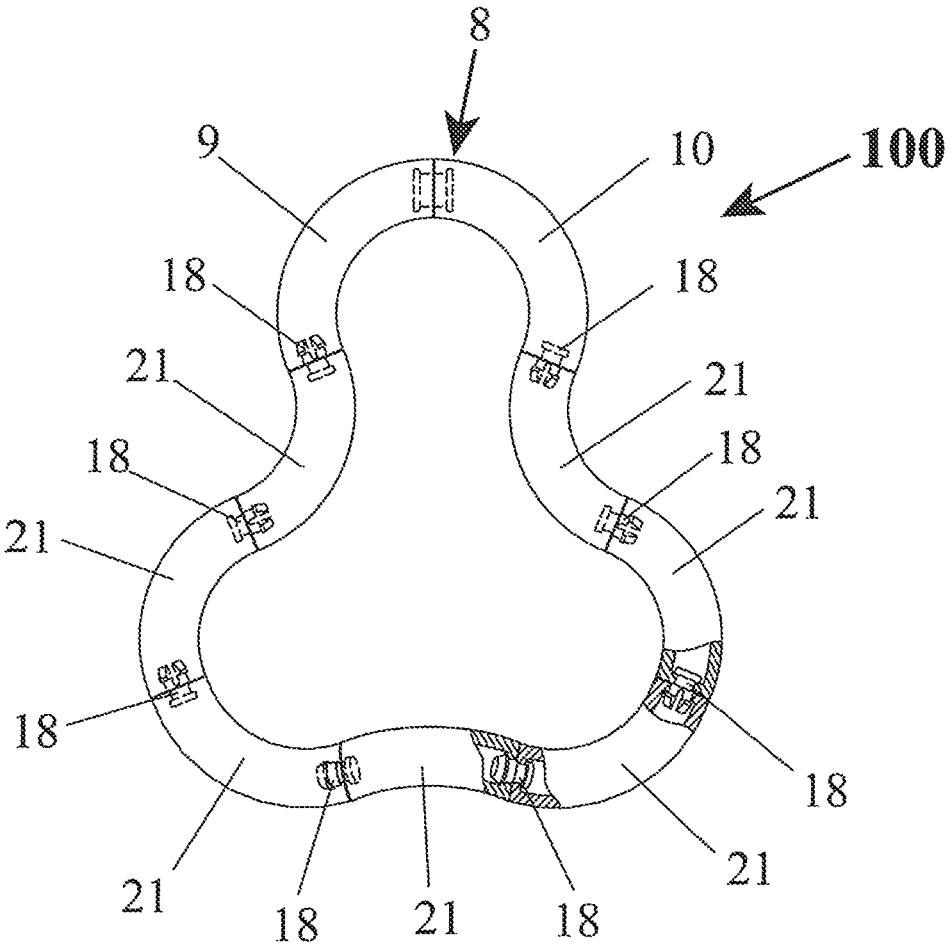
FIG. 4*d* shows an exemplary embodiment of the construction toy, according to one embodiment of the present invention.

FIG. 4*d* shows a power module 8 linked to a slave segment having a plurality of slave members 21 to form a construction toy 100. As shown, the slave segment has seven slave members 21, for example. Each slave member 21 can be made of a tube having one end similar to the first module end 30 and another end similar to the second module end 32 of the power module 8 (see FIG. 2).

Figure 5A:
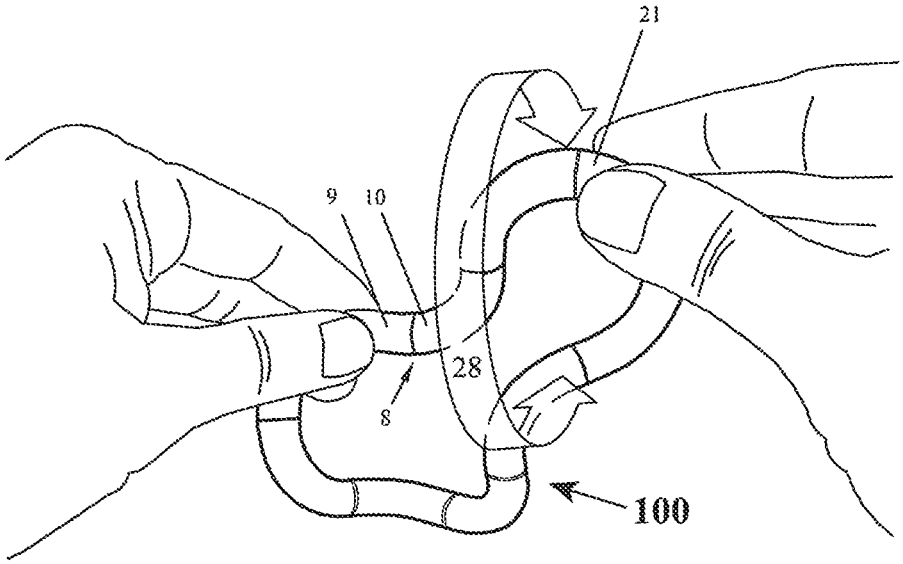
FIGS. 5*a* and 5*b* show manipulation of the power module, according to the present invention.
Figure 5B:
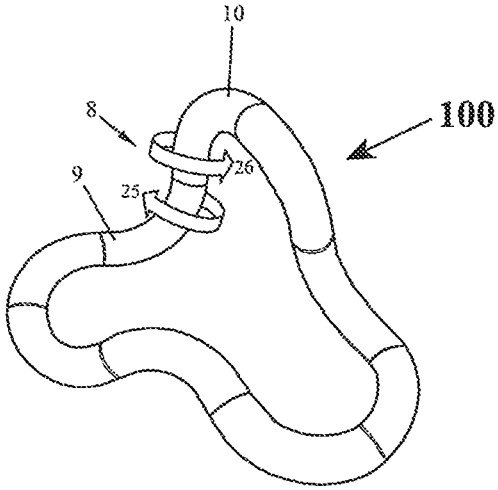

Referring now to FIGS. 5*a* and 5*b*, while torus segment 9 of power module 8 is held stationary, the second slave member 21 joining torus segment 10 can be used to crank the power module 8 in a rotation direction 28, which can be either a clockwise or counter clockwise direction. Upon releasing of the power module 8, torus segments 9 and 10 revolve in opposite direction 25, 26 to set the whole torus structure of the construction toy 100 in motion. It is understood that, as the power module 8 is cranked as illustrated in FIG. 5*a*, the core assembly therein receives the kinetic energy from the twisting of the flexible rod (see FIGS. 3*a* and 3*b*) and the core assembly is operated in a state in which the received kinetic energy is stored as potential energy. When the power module 8 is released as shown in FIG. 5*b*, the length of the twisted flexible rod therein is shortened as the flexible rod unwinds itself to release the potential energy. As the rod length is shortened to a certain length, the posts 16, 17 at both ends of the power module 8 are again engaged with the grooves 15 (see FIGS. 3*a* and 3*b*). As such, the unwinding of the flexible rod in the power module causes the torus segments 9 and 10 to rotate in opposite directions, and the core assembly is operated in a state in which the stored potential energy is released into the form of kinetic energy. Another state of the core assembly is when the flexible rod is not wound.

It should be noted that the drawing figures are for illustrative purposes only. It is therefore intended to cover modifications and variations of the mechanical structure and the shape of various components of the construction toy as disclosed herein. Thus, although the present invention has been described with respect to one or more embodiments thereof, it will be understood by those skilled in the art that the foregoing and various other changes, omissions and deviations in the form and detail thereof may be made without departing from the scope of this invention.

What is claimed is:

1. A construction toy, comprising:

a power module; and a slave segment linked to the power module, wherein the power module comprises a core assembly operable at least in a first state and a second state, the core assembly configured to store kinetic energy as potential energy in the first state and to release the potential energy into kinetic energy in the second state, wherein the power module has a first module end and an opposing second module end, and the slave segment has a first segment end and an opposing second segment end, and wherein the first segment end of the slave segment is rotatably coupled to the second module end of the power module, and the second segment end of the slave segment is rotatably coupled to the first module end of the power module to form a closed loop, and wherein the core assembly comprises a flexible rod having a rod length, the flexible rod configured for twisting to store the potential energy, wherein the core assembly further comprises a bushing, the flexible rod arranged to pass through the bushing, and wherein the flexible rod comprises a first rod portion and a second rod portion with the bushing located between the first rod portion and the second portion.

2. The construction toy according to claim 1, wherein the power module further comprises a first tube for accommodating the first rod portion, and a second tube for accommodating the second rod portion, the first tube and the second tube arranged to rotatably engage with the bushing.

3. The construction toy according to claim 2, wherein the first tube has a first tube end arranged to engage with the bushing and a second tube end forming the first module end, and the second tube has a first tube end arranged to engage with the bushing and the second tube end forming the second module end.

4. The construction toy according to claim 3, wherein the flexible rod has a first rod end and an opposing second rod end, the first rod end located in the first rod portion, the second rod end located in the second rod portion, wherein the first rod end has a first restriction member and the second rod end has a second restriction member and wherein the first restriction member is arranged to engage with the first module end and the second restriction member is arranged to engage with the second module end, such that when the first tube is rotated relative to the second tube about a rotation direction, part of the flexible rod is caused to rotate along with the first tube, resulting in said twisting of the flexible rod to store the potential energy while the rod length is increased, and that when the rod length reaches a predetermined length, the first restriction member is arranged to disengage from the first module end.

5. The construction toy according to claim 4, wherein the first tube comprises two grooves formed therein near the second tube end, and the first restriction member comprises an anchor having two posts arranged to engage with the two grooves before the rod length reaches the predetermined length and to disengage from the two grooves when the rod length reaches the predetermined length, and wherein the first rod end has a pin inserted, in the flexible rod, and the anchor also has a slot arranged to engage with the pin such that part of the flexible rod is caused to rotate along with the first tube when the anchor is engaged with the two grooves in the first tube.

6. The construction toy according to claim 5, wherein the core assembly further comprises a first compression spring surrounding the first rod portion between the bushing and the first restriction member for providing an urging force toward the first restriction member, and a second compression spring surrounding the second rod portion between the bushing and the second restriction member for providing an urging force toward the second restriction member.

7. The construction toy according to claim 1, wherein the first module end of the power module and the second segment end of the slave segment are coupled together with a snap stud, and the first segment end of the slave segment and the second module end of the power module segment are coupled together with another snap stud to form the loop.

8. The construction toy set according to claim 1, wherein the slave segment comprises a plurality of segment tubes rotatably coupled together to form a chain.

9. The construction toy according to claim 1, wherein the first module end of the power module comprising a module stud and the second module end of the power module comprising a module receptacle; and wherein the first segment end of the slave segment comprising a segment stud configured to engage with the module receptacle and the second segment end of the slave segment comprising a segment receptacle configured to receive the module stud.

10. A power module for use in a construction toy, comprising;

a core assembly operable in a first state and a second state, the core assembly configured to store kinetic energy as potential energy in the first state and to release the potential energy into kinetic energy in the second state;

a bushing, the flexible rod arranged to pass through the bushing, wherein the flexible rod comprises a first rod portion and a second rod portion with the bushing located between the first rod portion and the second portion;

a first tube for accommodating the first rod portion; and a second tube for accommodating the second rod portion, the first tube and the second tube arranged to rotatably engage with the bushing.

11. The power module according to claim 10, wherein the core assembly comprises a flexible rod having a rod length, the flexible rod configured for twisting to store the potential energy.

12. The power module according to claim 10, further comprising a first module end and second module end, and wherein the first tube has a first tube end arranged to engage with the bushing and a second tube end forming the first module end, and the second tube has a first tube end arranged to engage with the bushing and the second tube end forming the second module end.

13. The power module according to claim 12, wherein the flexible rod has a first rod end and an opposing second rod end, the first rod end located in the first rod portion, the second rod end located in the second rod portion, wherein the first rod end has a first restriction member and the second rod end has a second restriction member, and wherein the first restriction member is arranged to engage with the first module end and the second restriction member is arranged to engage with the second module end, such that when the first tube is rotated relative to the second tube about a rotation direction, part of the flexible rod is caused to rotate along with the first tube, resulting in said twisting of the flexible rod while the rod length is increased, and that when the rod length reaches a predetermined length, the first restriction member is arranged to disengage from the first module end.

14. The power module according to claim 13, wherein the first tube comprises two grooves formed therein near the second tube end, and the first restriction member comprises an anchor having two posts arranged to engage with the two grooves before the rod length reaches the predetermined length and to disengage from the two grooves when the rod length reaches the predetermined length, and wherein the first rod end has a pin inserted in the flexible rod, and the anchor also as a slot arranged to engage with the pin such that the flexible rod is caused to twist along with the first tube when the anchor is engaged with the two grooves in the first tube.

15. The power module according to claim 14, wherein the core assembly further comprises a first compression spring surrounding the first rod portion between the bushing and the first restriction member for providing an urging force toward the first restriction member, and a second compression spring surrounding the second rod portion between the bushing and the second restriction member for providing an urging force toward the second restriction member.

16. A construction toy set comprising:

a power module; and a plurality of slave segments for forming a chain of slave segments configured to couple to the power module to form a closed loop, wherein the power module comprises:

a core assembly operable in a first state and a second state, the core assembly configured to store kinetic energy as potential energy in the first state and to release the potential energy into kinetic energy in the second state;

a bushing, the flexible rod arranged to pass through the bushing, wherein the flexible rod comprises a first rod portion and a second rod portion with the bushing located between the first rod portion and the second portion;

a first tube for accommodating the first rod portion; and a second tube for accommodating the second rod portion, the first tube and the second tube arranged to rotatably engage with the bushing.

17. The construction toy set according to claim 16, wherein the slave segments are configured to rotatably link together to form the chain.

* * * * *